US008584797B2

(12) United States Patent
Krauss

(10) Patent No.: US 8,584,797 B2
(45) Date of Patent: Nov. 19, 2013

(54) FALL ARRESTER FOR A CLIMBING PROTECTION SYSTEM

(75) Inventor: Markus Krauss, Feilitzsch (DE)

(73) Assignee: Honeywell Fall Protection Deutschland GmbH & Co. KG, Hof (DE)

( * ) Notice: Subject to any disclaimer, the term of this patent is extended or adjusted under 35 U.S.C. 154(b) by 309 days.

(21) Appl. No.: 12/444,345

(22) PCT Filed: Oct. 16, 2006

(86) PCT No.: PCT/EP2006/067469

§ 371 (c)(1),
(2), (4) Date: Apr. 3, 2009

(87) PCT Pub. No.: WO2008/046446

PCT Pub. Date: Apr. 24, 2008

(65) Prior Publication Data

US 2010/0012424 A1 Jan. 21, 2010

(51) Int. Cl.
*A62B 35/00* (2006.01)

(52) U.S. Cl.
USPC ..... 182/3; 182/8; 182/18; 182/36

(58) Field of Classification Search
USPC ..... 182/3, 8, 18, 36
See application file for complete search history.

(56) References Cited

U.S. PATENT DOCUMENTS 2,616,609 A * 11/1952 Herod ..... 182/8
3,348,632 A * 10/1967 Swager ..... 182/230
4,085,818 A * 4/1978 Swager ..... 182/48
4,111,280 A * 9/1978 Devine et al. ..... 182/8
4,193,475 A * 3/1980 Sweet et al. ..... 182/8
4,269,284 A * 5/1981 Swager ..... 182/8
5,265,696 A * 11/1993 Casebolt ..... 182/8
6,161,647 A * 12/2000 Braden et al. ..... 182/8

(Continued)

FOREIGN PATENT DOCUMENTS

DE 2060718 6/1972
DE 2637593 1/1978

(Continued)

OTHER PUBLICATIONS

Machine Translation of above Foreign Patent—WO2005/026491.*

(Continued)

*Primary Examiner* — Alvin Chin Shue
*Assistant Examiner* — Colleen M Chavchavadze
(74) *Attorney, Agent, or Firm* — Wood, Phillips, Katz, Clark & Mortimer

(57) ABSTRACT

The fall arrester (10) is part of a climbing protection system for preventing a user of a ladder, a platform or the like from falling. The fall arrester (10) is movable along a guide rail (12) and has a rotatably mounted pawl (18) which, in the event of a fall, runs against catching stops (16) in the guide rail (12). A connecting element (40) is attached to the pawl (18) and the user can be secured to the connecting element (40) by a lanyard. The connecting element (40) is hinged to the pawl (18). The connecting element (40) can be hinged to the pawl (18) such that the connecting element (40) is coupled releasably rotation-resistant to the pawl (18) and the coupling (50, 52) is released in the event of a predetermined force on the connecting element (40). The connecting element can be formed as a damping element (40) which deforms in the event of a predetermined force.

13 Claims, 7 Drawing Sheets

(56) References Cited

U.S. PATENT DOCUMENTS

| | | | | |
|---|---|---|---|---|
| 6,457,556 | B1 * | 10/2002 | Skade et al. | 182/8 |
| 6,725,969 | B1 * | 4/2004 | Meister | 182/8 |
| 6,837,337 | B2 * | 1/2005 | Thomas et al. | 182/8 |
| 7,708,116 | B2 * | 5/2010 | Martin et al. | 182/8 |
| 2006/0283662 | A1 | 12/2006 | Martin et al. | |

FOREIGN PATENT DOCUMENTS

| | | | |
|---|---|---|---|
| DE | 3426551 | | 5/1985 |
| DE | 29805788 | | 7/1998 |
| DE | 10224681 | | 11/2003 |
| DE | 20315230 | | 11/2003 |
| DE | 202005011338 | | 11/2006 |
| EP | 0168021 | | 1/1986 |
| GB | 1536354 | | 12/1978 |
| WO | WO2005/026491 | * | 3/2005 |

OTHER PUBLICATIONS

International Preliminary Report on Patentability issued in International Appln. No. PCT/EP2006/067469.

* cited by examiner

FALL ARRESTER FOR A CLIMBING PROTECTION SYSTEM

CROSS-REFERENCE TO RELATED APPLICATIONS

This application is a national stage application of International Application No. PCT/EP2006/067469, filed on Oct. 16, 2006, whose benefit is claimed.

TECHNICAL FIELD

The invention relates to a fall arrester which is part of a climbing protection system for preventing a user of a ladder, a platform or the like from falling.

The fall arrester is movable along a guide rail and has a rotatably mounted pawl which, in the event of a fall, runs against catching stops in the guide rail, whereby the fall arrester is arrested in the guide rail. A connecting element is attached to the pawl and the user can be secured to the connecting element by a lanyard.

The connecting element can be formed as a deformable damping element.

STATE OF THE ART

In a fall arrester of this type known from DE-U-298 05 788, the damping element is formed in one piece with the pawl.

A fall arrester in which the rotatably mounted pawl is coupled in a positive-locking way to a fastening element is known from DE-A-102 24 681, wherein the fall arrest force which occurs when the secured person falls releases the positive locking, with the result that the pawl can swivel by elastic force against the catching stops in the guide rail and the fall arrester arrests in the guide rail.

A fall arrester is known from DE 203 14 230 in which the pawl is formed in one piece with the body of the fall arrester and a suspended latch on which the lanyard is fastened is hinged to the body. The suspended latch is U-shaped. When the fall arrester engages with the guide rail in the event of a fall, the U-shape of the suspended latch is bent open and the fall arrest force is thereby damped.

An arresting gear for a climbing protection system is known from DE-A-34 26 551 in which the connecting element is a steel ring dented roughly in the shape of a kidney which is stretched in the event of a fall. Fall energy is reduced by the stretching and the fall arrest force is thereby damped.

A damping device for a safety harness is known from DE-A-26 37 593 which contains a section folded repeatedly in a zigzag which likewise absorbs part of the fall energy in the event of a fall and thereby damps the fall arrest force.

Technical Object

The object of the invention is to create a fall arrester which locks securely in the event of a fall and in which the arrest cannot be released by any oscillating movement of the person secured to it.

Technical Solution

According to the invention, this object is achieved by the connecting element being hinged to the pawl.

Advantageous Effects

The hinge connection transmits any oscillating movements of a person suspended from the connecting element to the pawl to only a small extent, if at all, with the result that the latter cannot release itself from its arrested state.

The connecting element can be simultaneously formed as a damping element. The connecting element is preferably a damping element with a non-rectilinear shape. In the event of a fall, the damping element is deformed into a more rectilinear shape by the fall energy, whereby the fall arrest force is damped. The damping element can be U-shaped for example, wherein the end of one leg of the U is hinged to the pawl while the end of the other leg of the U has a lug from which the person to be secured can hang by the lanyard. When the fall arrester locks in place in the rail in the event of a fall, the U-shaped damping element is stretched and bent open into a straight shape, whereby the fall arrest force is damped. The damping element preferably consists of a single- or multi-folded or cold-rolled flat steel bar. The intensity of the fall arrest force can be limited by the dimensioning of the flat steel bar. In the event of a fall, a maximum of 6 kN can act on the person. To limit the fall arrest force to approximately 4 kN, the flat steel bar has a cross-section of 8×10.5 mm-material 1.4301 steel.

The pawl is hinged at one end, its upper end, in the body of the fall arrester. Its other end, the lower end, is formed as a pawl tooth. The pawl is pre-stressed by a spring, with the result that the pawl tooth is pressed against the catching stops in the rear of the guide rail.

Although the connecting element is hinged to the pawl in the normal state, i.e. as long as there is no fall, the connecting element is preferably prevented from rotating relative to the pawl. This can be achieved for example by having, projecting at the connecting element, a toothed tip which lies under a finger jutting out from the pawl and is extended beneath the finger only by the forces occurring in the event of a fall, whereby the connecting element is then released for a rotation at the pawl. If, in this embodiment, the secured person climbs up or down a ladder, then the fall arrester hangs from the lanyard and the lug in the connecting element or the other connection point is chosen such that the elastic force is then overcome by the weight of the fall arrester hanging from the lanyard, with the result that the pawl is swivelled back into the fall arrester. The torque which is exerted on the pawl by the elastic preload is thus smaller than the torque produced by the weight of the fall arrester, when the fall arrester is held at the lug. The point at which the connecting element is hinged to the pawl is selected such that the torque which is produced by the weight of a person hanging from the connecting element acts in the same direction as the torque of the elastic preload and the pawl additionally presses against the catching stops.

The arrangement of the points of rotation and the length of the lever arms are moreover preferably chosen such that the pawl is also then withdrawn from the arrested position if the user leans away from the ladder or guide rail (backward pull), with the result that the lanyard runs approximately horizontally. The fall arrester is preferably unlocked when the connecting line between the point of rotation of the pawl and the stop point, i.e. the lug in the connecting element, forms an angle of a few degrees with the horizontal. This is expedient in order to prevent the fall arrester from being arrested when climbing down. The person introduces a force of up to approximately 600 N into the connection means in the process.

The point of rotation at which the connecting element is hinged to the pawl can lie e.g. approximately in the centre between the point of rotation of the pawl and the lug of the connecting element, wherein the line connecting these three points is inclined downwards from the horizontal by approximately 5 degrees when the fall arrester runs in a vertical guide rail and the pawl is withdrawn.

It is not necessary to form the hinge between the connecting element and the pawl such that it is locked in the normal state. In the above-described embodiment the locking can be dispensed with, although it is then still possible only to descend with backward pull. Through the backward pull a torque is exerted, via the connecting element, on the pawl that overcomes the torque produced by the elastic preload. No backward pull is necessary when climbing up, since the pawl is bevelled, with the result that the catching stops can be overridden.

The advantages achievable by the invention manifest themselves in particular in the embodiment in which the connecting element is formed as a damping element which deforms in the event of a fall. In the case of a single-piece pawl with damping element, as known from DE-U-298 05 788, the geometric arrangement of pivot pins of the pawl and lug is optimal per se for the carabiner of the lanyard and in the event of a fall arrests the fall arrester very quickly and securely in the guide rail. However, as a result of the fall the damping element is bent open downwards in the form of a swan's neck, with the result that the geometric lever ratios (larger lever arm) change (deteriorate) to such an extent that the pawl can very easily be unlocked again (with a small horizontal pull). In the case of the fall arrester according to the invention with a two-part hinged pawl, the geometric ratios in the normal state are identical to those of a fall arrester according to DE-U-298 05 788, but completely different after the fall: because of the two-part formation of the hinged pawl, the lever ratios are also almost identical after the damping element has been bent open in the form of a swan's neck, i.e. by the damping element being hinged at the top to the pawl, the bent-open damping element swivels upwards approximately into the horizontal in the event of a horizontal backward pull and thus there is a much smaller lever arm. The damping element can thus be moved upwards freely at a certain angle, without unlocking the pawl in the process.

However, from a certain angle or if there is a sufficiently strong backward pull or upward pull, with the fall arrester according to the invention, the pawl can also be unlocked again and the fall arrester can continue to be moved in the rail. This is not possible in the case of a fall arrester according to DE-A-102 24 681, since there the two components, pawl (arresting member) and brake-activation element, are completely uncoupled in the event of a fall.

BRIEF DESCRIPTION OF THE DRAWINGS

An embodiment example of the invention is described below with the help of the drawing. There are shown in.

WAY(S) OF CARRYING OUT THE INVENTION

Figure 1:
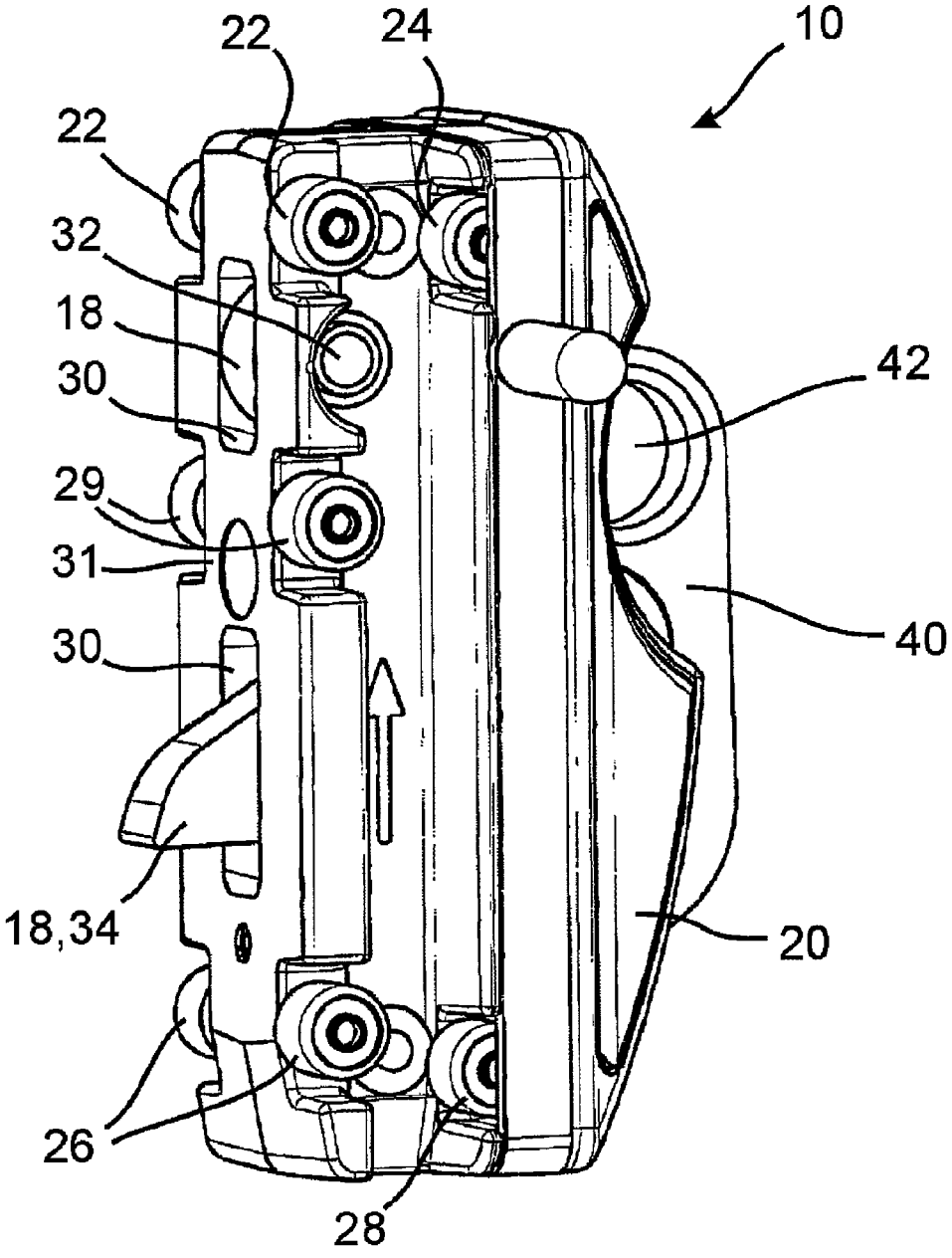
FIG. 1, the fall arrester obliquely from below.
Figure 2:
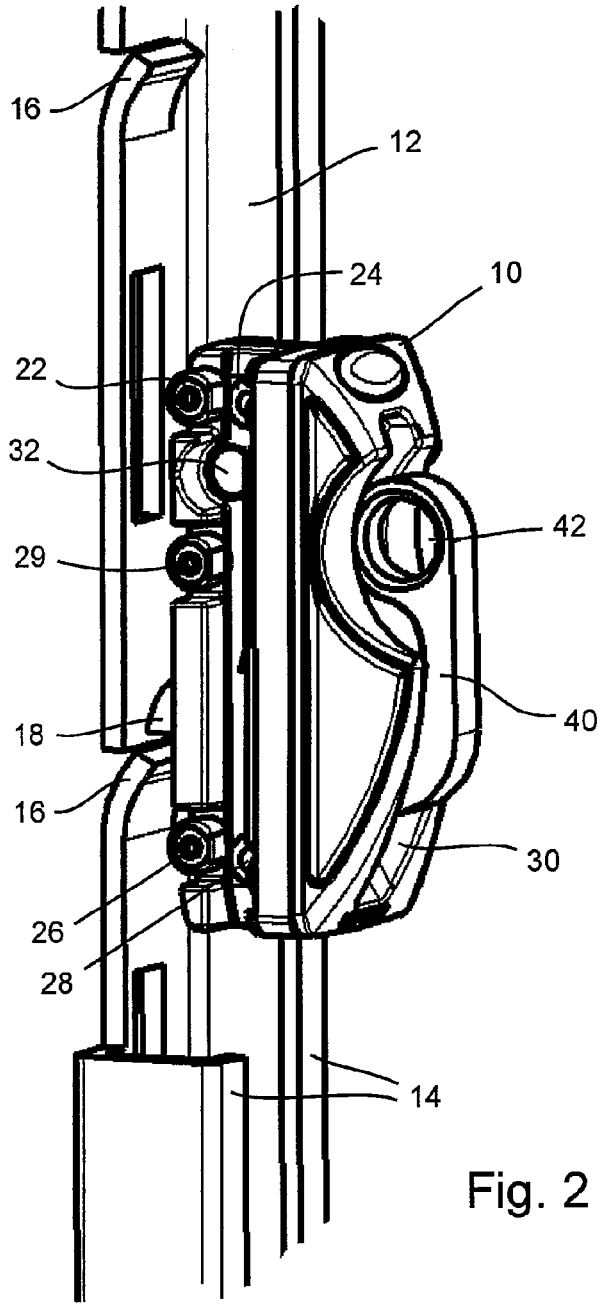
FIG. 2, the fall arrester, inserted into a guide rail, inclined from above, wherein the guide rail is cut open.

According to FIGS. 1 to 4, the fall arrester 10 is guided in a guide rail 12. The guide rail 12 is normally arranged vertically. The guide rail has the C-profile known from EP-A-0 168 021 which is open towards the front, i.e. towards the user, wherein the opening edges of the C-profile serve as a guide flange 14. Catching stops 16 projecting into the inside of the guide rail 12 are pressed out in the rear of the guide rail.

The fall arrester 10 has a body 20, oblong overall, extending in the direction of the guide rail with a pawl 18 rotatably mounted therein. Two pairs of rollers 22, 24 are provided at the front end of the body 20. The inner pair of rollers 22 runs on the inside of the guide flange 14, while the outer pair of rollers 24 runs on the outside of the guide flange 14. The rollers 22, 24 are mounted on journal bearings which are fastened rigidly to the body 20. The inner rollers 22 remain at a distance from the outer rollers 24 that is somewhat greater than the material thickness of the guide flange 14. Two similar pairs of rollers 26, 28 are provided at the rear end of the body 20, wherein the inner pair of rollers 26 again runs on the inside of the guide flange 14, while the outer pair of rollers 28 runs on the outside of the guide flange 14. Yet another inner pair of rollers 29 is provided between the two inner pairs of rollers 22 and 26.

The body 20 of the fall arrester 10 has a slit-shaped opening 30 in which the pawl 18 is mounted rotatably on a pin 32 for pivoting around a horizontal axis A. The opening 30 is closed for a short distance 31 on the underside of the fall arrester 10 by the third inner pair of rollers 29. The tooth 34 of the pawl 18 projects from the fall arrester 10 into the inside of the C-profile of the guide rail until it meets the catching stops 16 which project inwards from the rear of the rail. The pin 32 is located in the upper region of the pawl.

The pawl 18 is subject to the action of a pressure spring 36 which presses against the pawl 18 above the pin bearing, with the result that the tooth 34 projects as far as possible. To this extent, the design and use of the carriage 10 corresponds to the carriage according to DE-U-298 05 788 and DE-U-299 20 850 to which reference is made for details.

A damping element 40 is hinged to the pawl 18 on the side facing the user and slightly below the pin 32. The damping element 40 acts as connecting element and has a lug 42 from which a lanyard or other safety harness of the user can be suspended. To form the joint between the pawl 18 and the damping element 40, the pawl is recessed on both sides at 44 near the pin 32 approximately in the shape of a semi-circle, with the result that the material thickness of the pawl 18 is approximately halved in this region. The damping element 40 is U-shaped overall, and the end of one leg of the U is incised, and this incision sits on the pawl 18 in the region of smaller thickness. The damping element 40 is fastened to the pawl 18 by a pivot pin 46 for pivoting movement around a horizontal axis A1, that is spaced from the axis A. The shape of the recesses 44 and the shape of the end of the first leg of the U are matched to each other such that the damping element 40 has a swivel range of approximately 45 degrees downwards from the horizontal.

Figure 3:
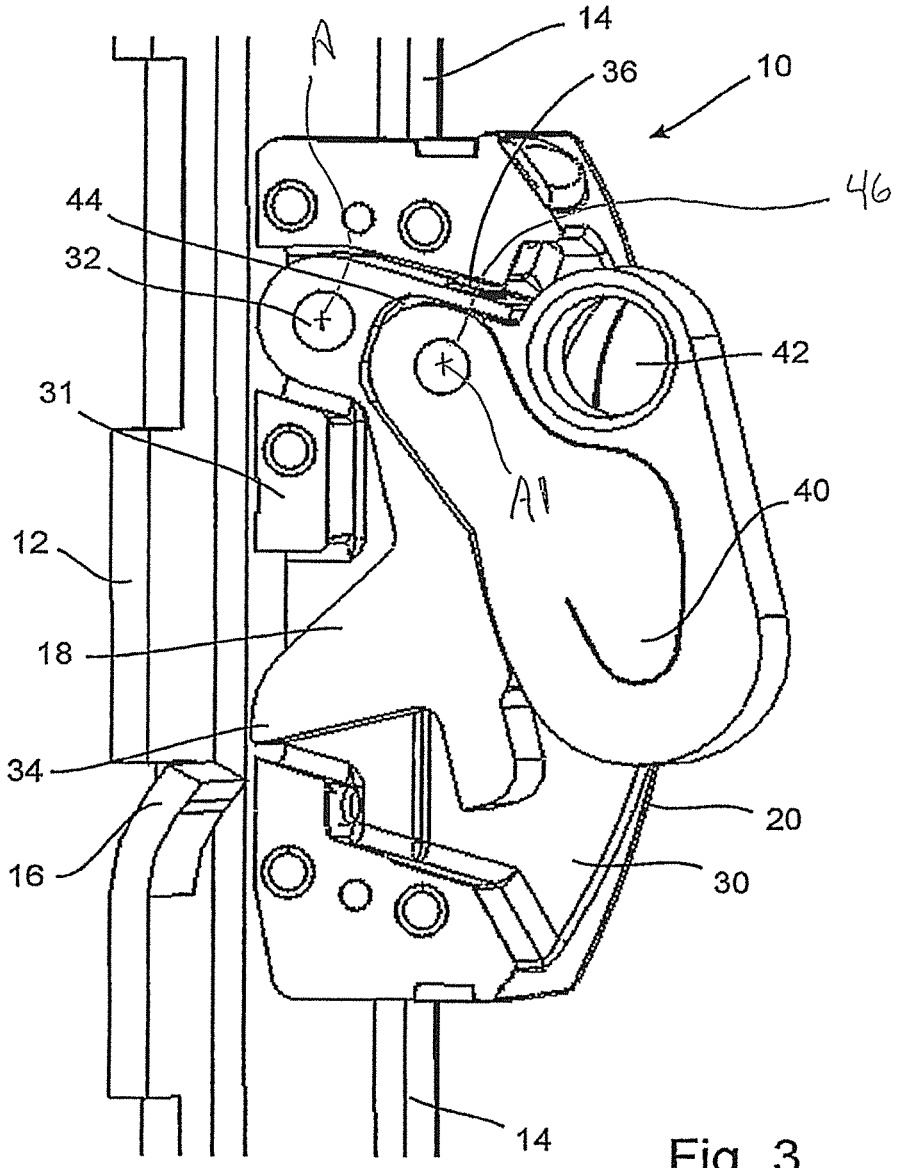
FIG. 3 in vertical section, the fall arrester in the unlocked position.
Figure 4:
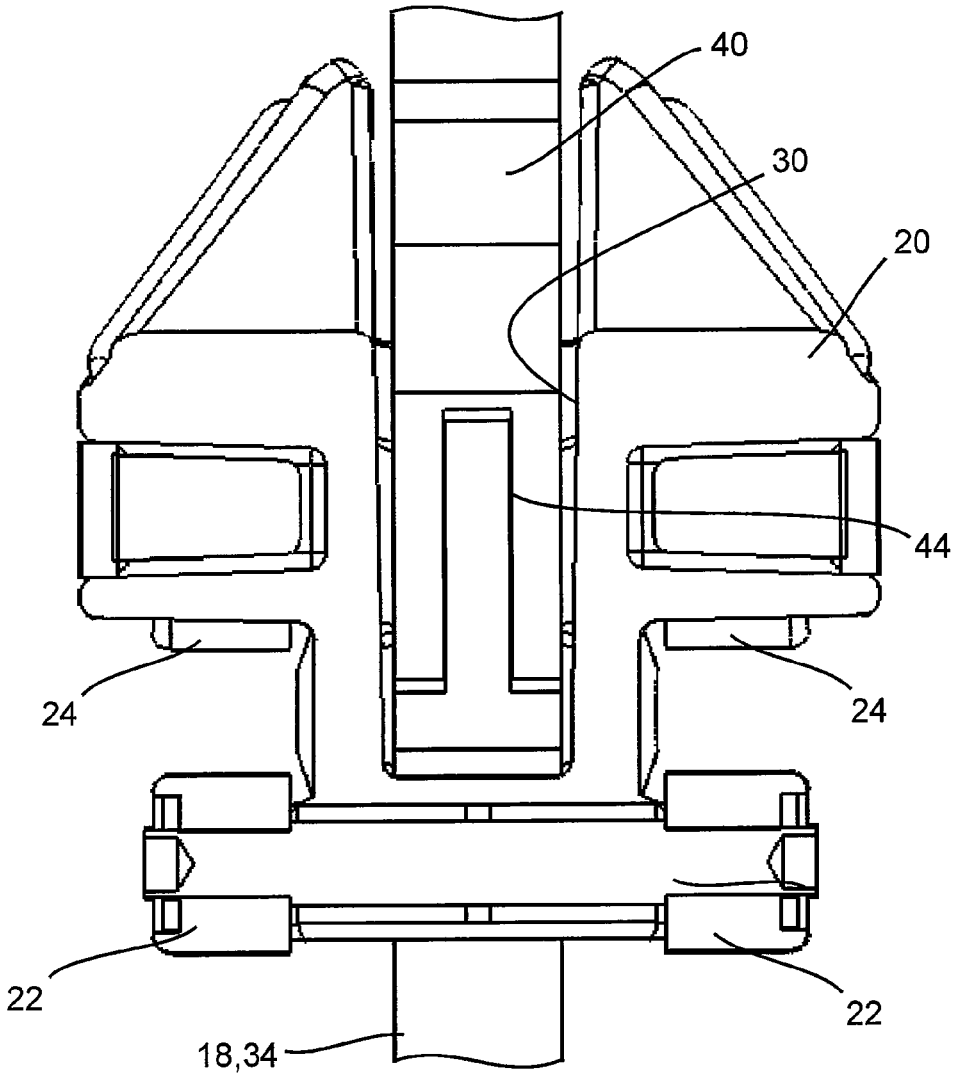
FIG. 4, the fall arrester from FIG. 3 in horizontal section.

In the normal state, as shown in FIGS. 1 and 3, the two U-legs of the damping element are aligned approximately parallel and the damping element 40 rests tightly against the pawl 18. In this state, the damping element 40 is secured to the pawl 18 by a toothed tip 50 which is held below a projecting finger 52 of the pawl 18 so that the damping element 40 and pawl 18 co-rotate around the axis A. The lug 42 to which the lanyard is attached is also located at the end of the second U-leg.

Figure 5:
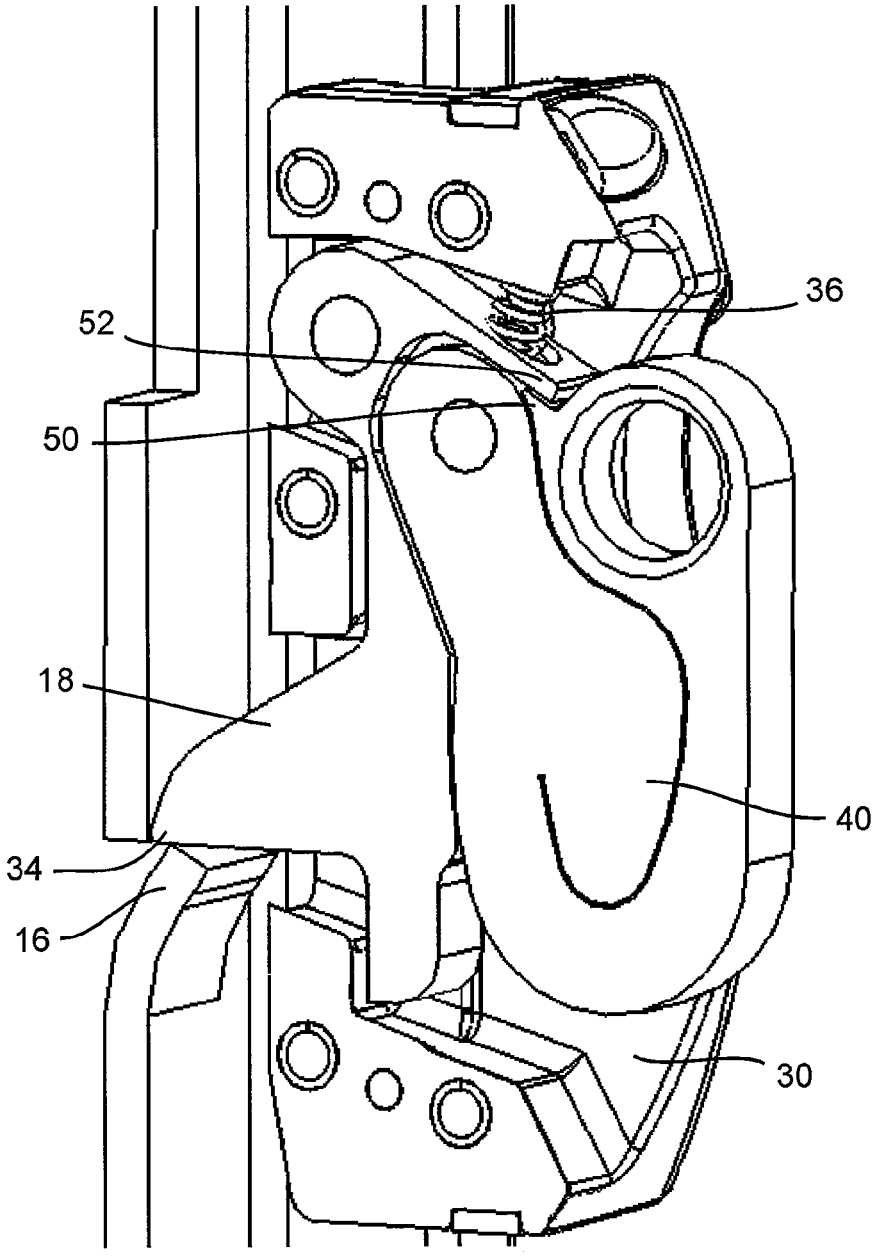
FIG. 5, the fall arrester from FIG. 3 in the arrested position.
Figure 6:
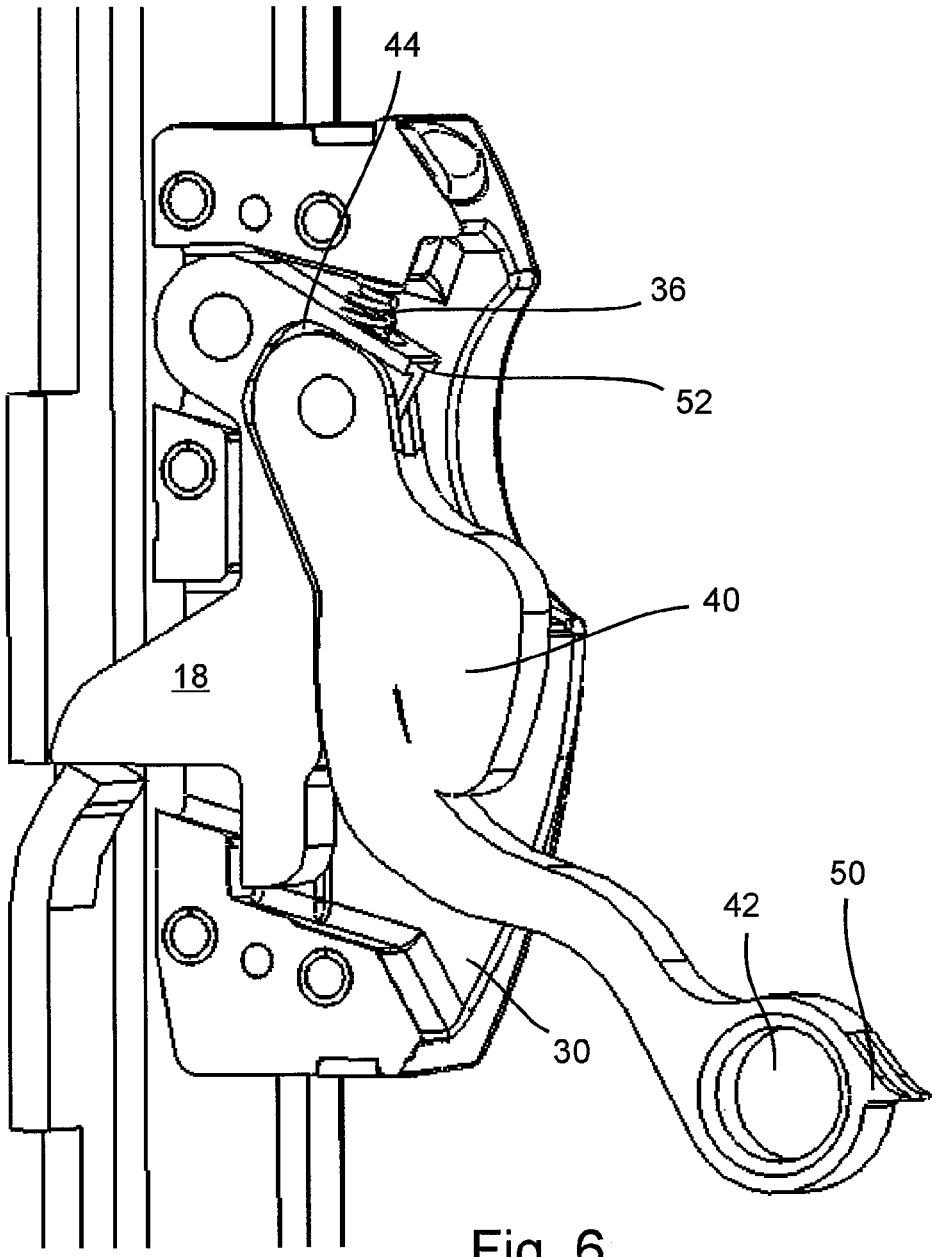
FIG. 6, the fall arrester from FIG. 3 in the arrested position with opened damping element and FIG. 7, the fall arrester from FIG. 5 with opened damping element swivelled upwards.
Figure 7:
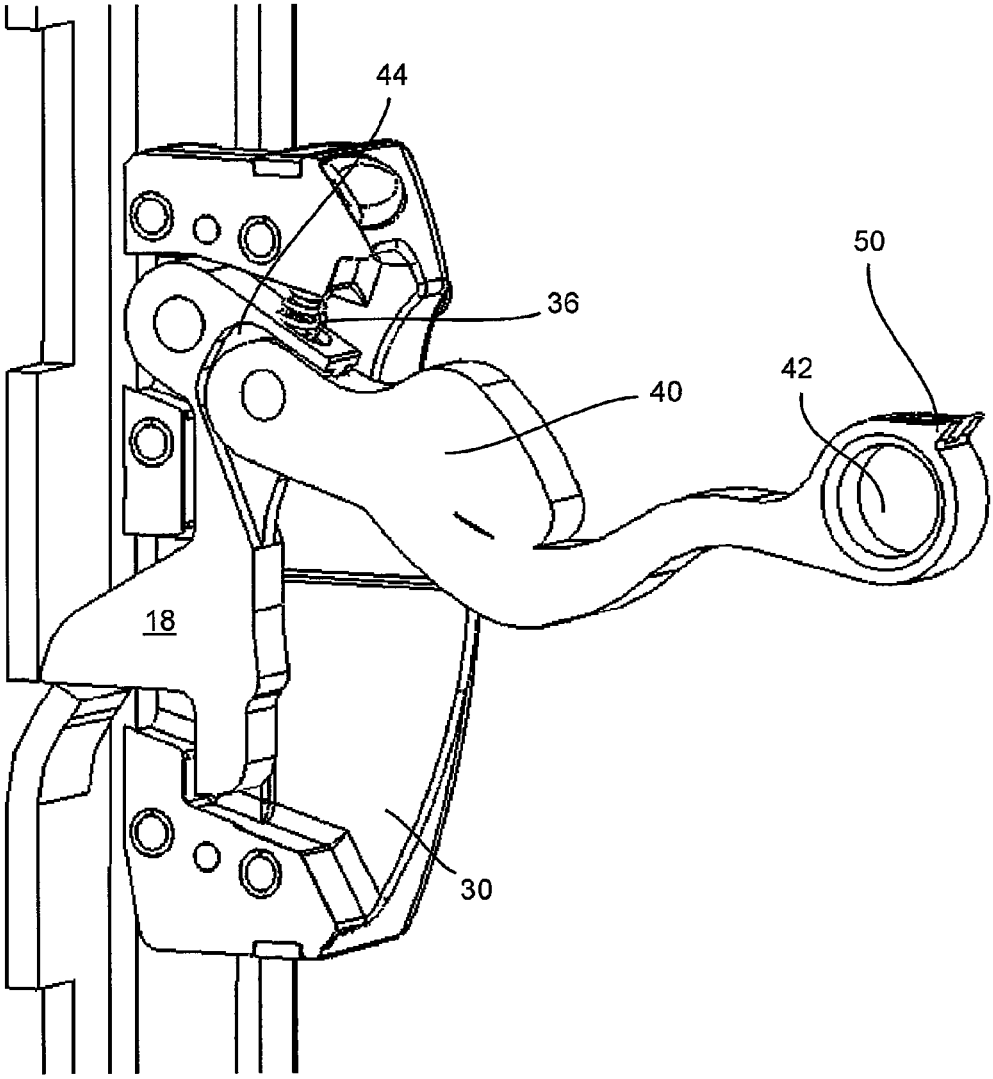

In the event of a fall, the pawl 18 is first pressed through the damping element 40 by the elastic preload in one direction around the axis A into the position shown in FIG. 5 in which the pawl 18 engages with a catching stop 16. The fall arrest force is conducted into the damping element 40 via the lanyard attached to the lug 42. The toothed tip 50 is extended below the finger 52 by the fall arrest force and the damping element 40 is bent out of its initial U-shape state into a different state wherein it has a largely stretched shape. The fall arrest force is thereby damped. Since the toothed tip 50 is now no longer held fast by the finger 52, the damping element 40 can swivel freely at the pawl 18. In the event of a fall, the second U-leg is first pulled downwards, as shown in FIG. 6. It may happen that, due to an elastic rebound of the system, the damping element 40 shoots upwards (FIG. 7). Because, in its bent-open shape, the damping element 40 is no longer rigidly connected to the pawl 18, but rather only hinged to it, such a movement of the damping element 40 cannot lead to the pawl 18 releasing itself from the catching stop 16.

REFERENCE LIST

10 Fall arrester
12 Guide rail
14 Guide flange
16 Catching stops
18 Pawl
20 Body
22 Rollers
24 Rollers
26 Rollers
28 Rollers
29 Further rollers
30 Opening
31 Distance
32 Pin
34 Tooth
36 Pressure spring
40 Damping element
42 Lug
44 Recess
50 Toothed tip
52 Finger

The invention claimed is:

1. A fall arrester which is part of a climbing protection system for use by a user of a ladder, a platform or the like to prevent the user from falling, wherein the fall arrester is adapted to be used with, and to be movable along, a guide rail having catching stops, the fall arrester comprising:

a body; and a pawl having upper and lower ends and comprising:

a pawl tooth at the lower end of the pawl, the pawl rotatably mounted to the body for movement relative to the body around a first axis and configured so that the pawl tooth engages the catching stops in the guide rail in the event of a fall as an incident of which the pawl rotates in a first direction relative to the body around the first axis; and a connecting element which is hinged to the pawl for pivoting movement relative to the pawl around a second axis and, with the fall arrester used by a user, to which the user can be secured using a lanyard, the second axis having a fixed location relative to the first axis, wherein the connecting element and the pawl are separate parts which are connected to each other such that with the connecting element in a first state, the connecting element and pawl co-rotate around the first axis, whereby in response to the application of a predetermined downward force upon the connecting element, as through a lanyard in the event of a fall by a user, the connecting element causes the pawl to pivot in the first direction around the first axis relative to the body so that the pawl tooth engages a first catching stop and the connecting element assumes a second state wherein the connecting element is allowed to pivot around the second axis relative to the pawl with the second axis maintained in a fixed location relative to the first axis and without causing the pawl tooth to disengage from the first catching stop.

2. The fall arrester according to claim 1, wherein the pawl is hinged at its upper end to the body of the fall arrester, and wherein the pawl is pre-stressed by a spring so that the tooth on the pawl is urged against the catching stops of the guide rail, when said fall arrester is used with the guide rail.

3. The fall arrester according to claim 1, wherein the connecting element is formed as a damping element which deforms upon the application of the predetermined force.

4. The fall arrester according to claim 1 wherein with the connecting element in the second state, the connecting element is rotatable relative to the body around the second axis in a predetermined range.

5. The fall arrester according to claim 4 wherein the predetermined range is approximately 45°.

6. The fall arrester according to claim 1 wherein the pawl is recessed to define a region within which the connecting element resides.

7. The fall arrester according to claim 6 wherein the connecting element is U-shaped with separate legs and one of the separate legs of the connecting elements resides in the recessed region of the pawl.

8. The fall arrester according to claim 1 wherein the first and second axes are normal with respect to the longitudinal direction of the body.

9. The fall arrester according to claim 1 wherein the first and second axes are spaced from each other.

10. The fall arrester according to claim 1 wherein with the connecting element in the first state, a toothed tip on the connecting element engages a projecting finger on the pawl to cause the pawl and connecting element to co-rotate in one direction around the first axis.

11. The fall arrester according to claim 10 wherein the toothed tip on the connecting element disengages from the projecting finger on the pawl as an incident of the connecting element changing from the first state into the second state.

12. The fall arrester according to claim 1 wherein the first axis is defined by a pin.

13. The fall arrester according to claim 1 wherein the second axis is defined by a pin.

* * * * *